US008796944B2

(12) United States Patent
Boland et al.

(10) Patent No.: US 8,796,944 B2
(45) Date of Patent: Aug. 5, 2014

(54) SOLID STATE ILLUMINATING SYSTEM

(76) Inventors: Bernard W. Boland, Mesa, AZ (US); Jim Rhodes, Tempe, AZ (US)

( * ) Notice: Subject to any disclaimer, the term of this patent is extended or adjusted under 35 U.S.C. 154(b) by 215 days.

(21) Appl. No.: 13/276,436

(22) Filed: Oct. 19, 2011

(65) Prior Publication Data

US 2013/0099677 A1 Apr. 25, 2013

(51) Int. Cl.
*H05B 41/16* (2006.01)

(52) U.S. Cl.
USPC ..... 315/246

(58) Field of Classification Search
USPC ..... 315/291, 307, 312, 224, 246, 247
See application file for complete search history.

(56) References Cited

U.S. PATENT DOCUMENTS

| | | | | |
|---|---|---|---|---|
| 7,178,941 | B2 * | 2/2007 | Roberge et al. | 362/225 |
| 2006/0082331 | A1 * | 4/2006 | Ashdown | 315/291 |
| 2009/0085494 | A1 * | 4/2009 | Summerland | 315/291 |
| 2009/0184648 | A1 * | 7/2009 | Colak et al. | 315/158 |
| 2010/0213854 | A1 * | 8/2010 | Rains et al. | 315/149 |
| 2011/0180687 | A1 * | 7/2011 | Rains et al. | 250/205 |

* cited by examiner

*Primary Examiner* — Minh D A
(74) *Attorney, Agent, or Firm* — Richard C. Vershave; Foster Pepper, PLLC

(57) ABSTRACT

The present invention provides a solid state illuminating system having a centralized controlling module, coupled with a monitoring module and a power supplying module, for converting electricity from a second format to a third format so as to embed a PWM signal therein in accordance with a status signal obtained by an user via a monitoring module. Accordingly, the present invention is capable of supporting various kinds of potential dimming control method and has the advantage of low manufacturing cost without substantially adjustment to the present illumining system.

7 Claims, 2 Drawing Sheets

SOLID STATE ILLUMINATING SYSTEM

BACKGROUND OF THE INVENTION

1. Field of the Invention

Figure 1:
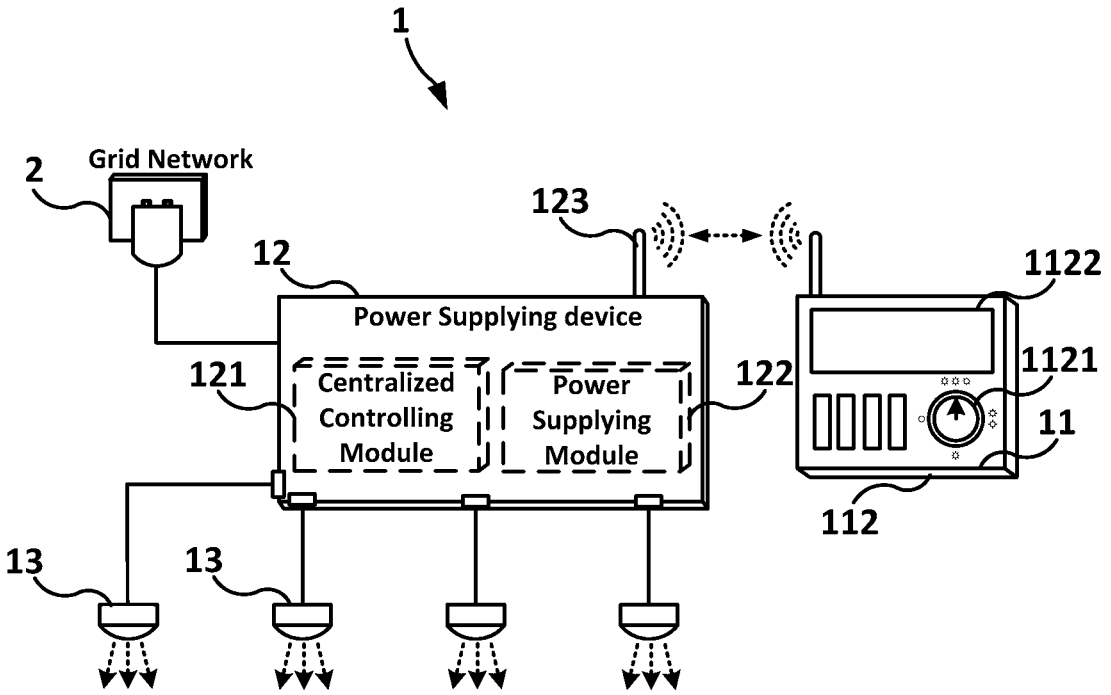

The present invention relates to a low cost solid state illuminating system having a centralized controlling module.

2. Description of the Prior Art

Nowadays, as solid state illuminating system becomes more and more popular in the market, there are various types of solid state illumination driving systems. The driving system is basically utilized to provide constant current or constant voltage to the solid state illumination device or solid state illumination method in order to maintain a constant luminous output thereof.

However, if function of dimming is required in the traditional illuminating system, each illuminating module in the traditional solid state illuminating system requires a corresponding dimming controlling module for adjusting the propriety of the electricity inputted to each of the corresponding illuminating module. Furthermore, considering the cost issue, each of the corresponding dimming controlling module of the illuminating system usually supports only one certain type of dimming controlling method which limit the utility thereof.

Therefore, a need exists, for an intelligent, modular and low cost solid state illuminating system which is capable of supporting various types or standards of dimming control method.

SUMMARY OF THE INVENTION

The present invention provides a solid state illuminating system. The solid state illuminating system comprises a monitoring module, a power supplying module, a centralized controlling module and a plurality of remote illuminating modules.

The monitoring module is capable of generating a status signal in accordance with the optical condition such as where it is disposed or the user command obtained by the user interface thereof. Generally, the monitoring module of the present invention may further comprise a photo-sensing unit, for detecting the optical condition from where the photo-sensing unit is disposed.

The power supplying module is capable of and be utilized to receive an electricity with a first format so as to output an electricity with a second format. The centralized controlling module is coupled with the monitoring module and the power supplying module which is utilized to convert the electricity from the second format to a third format embedded with a PWM signal in accordance with the status signal provided by the monitoring module, wherein the status signal may be either in analog format or digital format. Moreover, the first format, second format and the third format can be either AC or DC respectively.

Furthermore, each of the plurality of remote illuminating modules is connected with the controlling module for obtaining the electricity with the third format so as to generate a light ray in accordance with the PWM signal embedded in the electricity with a third format respectively. In actual practice, each of the plurality of the remote illuminating modules is connected with the power supplying module via a power supplying rail respectively. The monitoring module may further comprise a potentiometer. Moreover, the controlling module may also be capable of monitoring the AC phase of the electricity with the second format for processing a phase cut dimming function with a trailing type lighting dimmers or a TRIAC type lighting dimmer.

In summary, the present invention provides an intelligent, modular and low cost solid state illuminating system which is capable of supporting various types or standards of dimming control method.

BRIEF DESCRIPTION OF THE APPENDED DRAWINGS

The teachings of the present invention can be readily understood by considering the following detailed description in conjunction with the accompanying drawings, in which:

FIG. 1 depicted a schematic view of one embodiment of the illumining system of the present invention.

Figure 2:
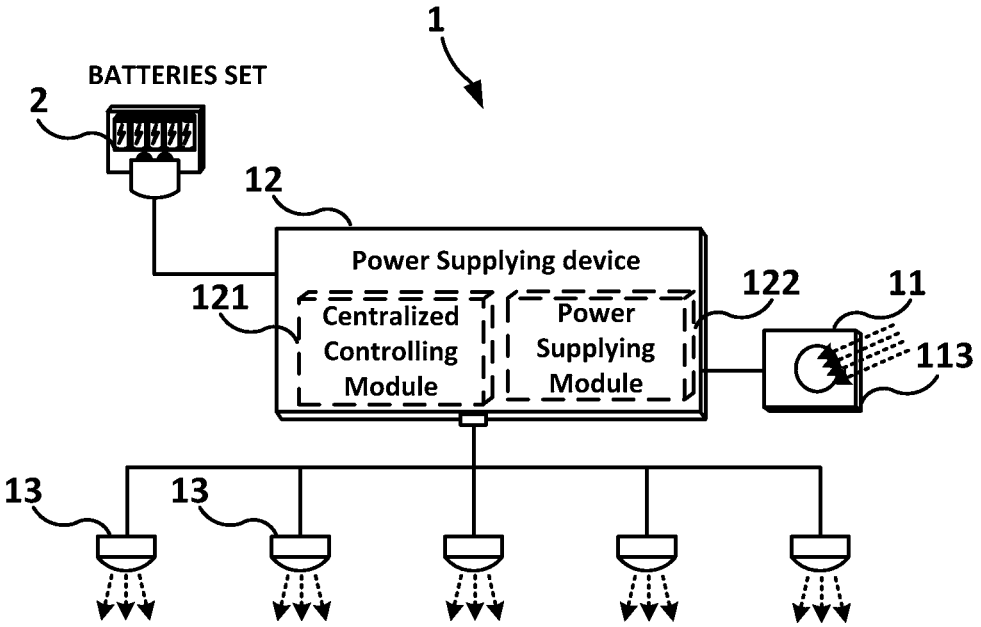

FIG. 2 depicted a schematic view of another embodiment of the illumining system of the present invention.

Figure 3:
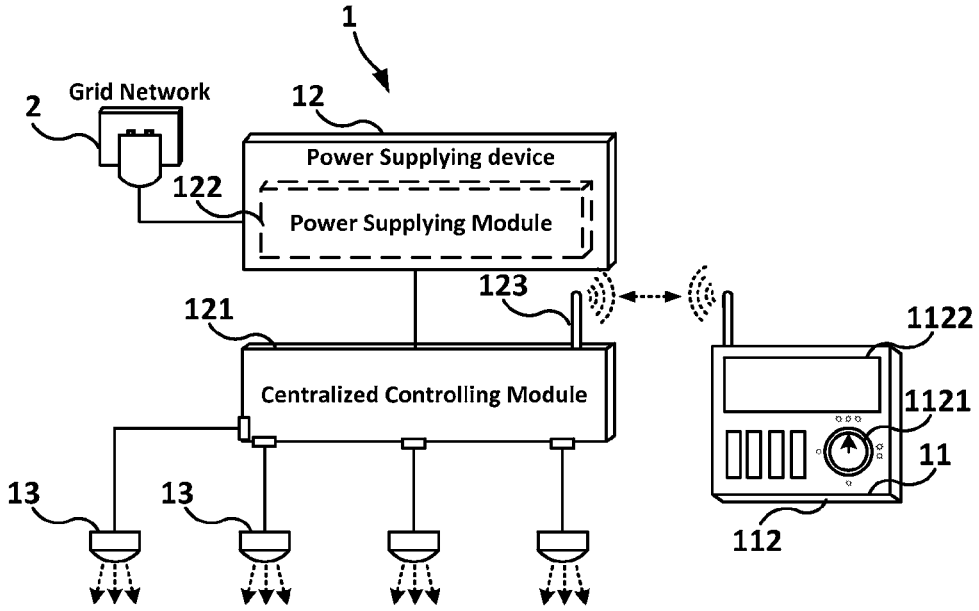

FIG. 3 depicted a schematic view of another embodiment having an independent operating centralized controlling module.

Figure 4:
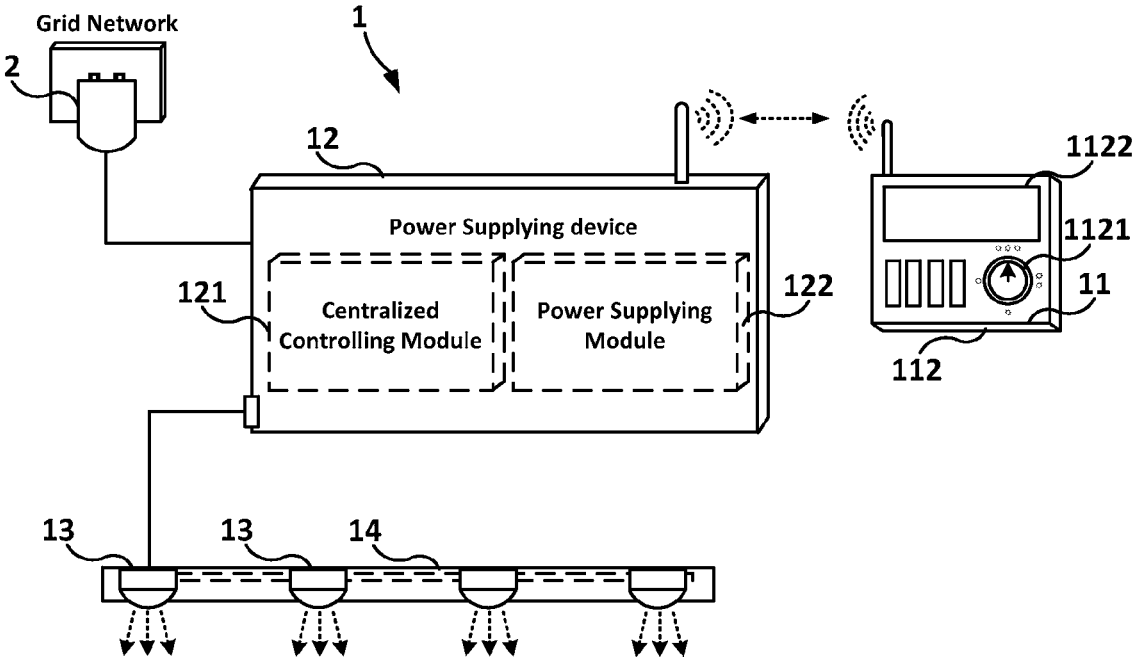

FIG. 4 depicted a schematic view of another embodiment having a power supplying rail.

DETAILED DESCRIPTION OF THE INVENTION

The present invention generally provides an illumining system 1, more specifically, the present invention discloses a solid state illumining system 1 with a plurality of solid state illumining module 13 therein. For clarity and ease of description, an actuation sequence of one embodiment of the invention is described below with reference with FIG. 1. FIG. 1 depicted a schematic view of one embodiment of the illumining system 1 of the present invention. With reference to FIG. 1, the present invention comprises a power source 2, a monitoring module 11, a power supplying device 12 and a plurality of illumining modules 13. Furthermore, each of the said components shall be described in detail hereinafter respectively.

In reference to the FIG. 1, the power source 2 of the present invention generally refers to a means or device capable of providing power to the present invention. More specifically, the power source 2 of the present embodiment is, but not limited to, a grid connected network, it can also be a power generating or power storing device, such as photo-PV, fuel cell, batteries set, power generator or any other means which is capable of providing electricity with a first format, wherein the first format may be electricity with AC or DC format.

The monitoring module 11 of the present invention is generally referred to a device capable of generating a status signal in accordance with the user command or the optical condition of the position where the module is disposed, wherein the monitoring module 11 can also be an external analog source or an external digital source. The external digital source can be a slide switch, capacitive sensing unit or any other device that is capable of generating a digital signal. Meanwhile, in the present embodiment, the monitoring module 11 is coupled with the power supplying device 12 via wireless communicating modules 123 for transmitting the status signal therebetween. However, the monitoring module 11 may also be coupled to the power supplying device 12 via wiring or wireless means capable of transmitting signal, power or data thereamong. Furthermore, the status signal may be either analog or digital format.

In reference to the FIG. 1, the monitoring module 11 of the present invention comprises an interface device 112. The said interface device 112 is utilized to obtain user command or present the details of the system to the user. The interface device 112 of the present embodiment comprises an inputting means 1121 and an outputting means. The inputting means 1121 of the present embodiment is formed by a plurality of capsense buttons and the outputting means 1122 of the present embodiment is a LCD displaying screen. However, the inputting means 1121 and the outputting means 1122 are not limited to the said embodiment, the inputting means 1121 and the outputting means 1122 can also be any other means, device, or module having the same or similar function correspondingly.

However, in reference to the FIG. 2, the monitoring module 11 of the present invention can also be a photo-sensing unit 113. The photo-sensing unit 113 is capable of detecting the light condition where the photo-sensing unit 113 is disposed so as to generate a corresponding status signal. The status signal generated by the monitoring module 11 can be in the analog format or digital format in accordance with the type of the monitoring module 11.

Please refer to the FIG. 1, the power supplying device 12 is generally referred to a device connected with the power source 2 and capable of receiving electricity with the first format so as to convert and output electricity with a second format. In the present embodiment, the power supplying device 12 comprises a power supplying module 122 and a centralized controlling module 121. However, the centralized controlling module 121 is also capable of operating independently shown as the FIG. 3. Furthermore, the first format is a gril supplied AC format electricity and the second format is a DC format electricity that converted by the power supplying module 122.

Please refer to the FIG. 1, the power supplying module 122 of the present embodiment is capable of receiving electricity with a first format and converting it into a plurality of second format electricity. Furthermore, the power supplying module 122 is also capable of assigning the plurality of second format electricity to the plurality of the remote illuminating modules 13 correspondingly, wherein the second format electricity may either be DC or AC format.

After each of the first format electricity of the remote illuminating module 13 is converted to the second format electricity, the second format electricity will be sent to the corresponding remote illuminating modules 13 via a centralized controlling module 121. The centralized controlling module 121 is capable of converting the second format electricity to a third format so as to embed a PWM signal therein in accordance with the status signal and output the third format electricity accordingly. Furthermore, the centralized controlling module 121 of the present invention can also operate independently from the power supplying device 12 shown as FIG. 3.

Moreover, the controlling module 121 is capable of monitoring the AC phase of the second format electricity for a phase cut dimming function, wherein the dimmers cut off the front-end of the AC half cycle are referred to leading edge or forward phase dimmers. The cut back-end of the AC half cycle is referred to trailing edge or reverse phase dimmers. The said phase-cut dimmers, as the name suggests, operate by controlling the power delivered to the solid state illuminating system by cutting off a portion of the input AC voltage waveform. Particularly, the dimming method of the present invention can be potentially determined or modified by the user. By the centralized controlling module 121, each of the remote illuminating modules 13 is capable of being adjusted independently.

Please refer to the FIG. 1, each of the plurality of remote illuminating modules 13 is generally be referred to a solid state light emitting device which is capable of converting the third format electricity to light accordingly. The said solid state light emitting device comprises, but not limited to, a plurality of LED chips. Furthermore, in the present embodiment, each of the remote illuminating modules 13 is connected with the centralized controlling module 121 for obtaining the electricity with the third format so as to generate a light ray in accordance with the PWM signal embedded therein respectively. Especially deserve to be mentioned, the number of the remote illuminating module is not limited to four and can be modified in accordance with the requirement of the user. Furthermore, the plurality of the remote illuminating modules 13 can also be installed on the power supplying rail 14 to be powered as depicted as FIG. 4.

In summary, by replacing and centralizing the expensive dimming controlling module of the plurality of the remote illuminating modules to the centralized controlling module, the present invention is capable of supporting various kinds of potential dimming control method and has the advantage of low manufacturing cost without substantially adjustment to the present illumining system.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A solid state illumining system, comprising:

a monitoring module, for generating a status signal;

a power source, isolated from grid network, comprising a photo-PV, for generating electricity with a first format;

a power supplying module, for receiving electricity with the first format so as to output electricity with a second format;

a centralized controlling module, coupled with the monitoring module and the power supplying module, for converting the electricity from the second format to a third format embedded with a PWM signal in accordance with the status signal; and a plurality of remote illuminating modules, each of the illuminating modules being connected with the controlling module for obtaining the electricity with the third format so as to generate a light ray in accordance with the PWM signal embedded in the electricity with a third format respectively;

wherein the controlling module is capable of monitoring the AC phase of the electricity with the second format for a phase cut dimming function with a trailing type lighting dimmer or a TRIAC type lighting dimmer.

2. The solid state illumining system of claim 1, wherein the monitoring module comprises an user interface, for generating the status signal in accordance with an user command inputted by the user.

3. The solid state illumining system of claim 1, wherein the status signal is in analog format.

4. The solid state illumining system of claim 1, wherein the status signal is in digital format.

5. The solid state illumining system of claim 1, wherein the monitoring module comprises a potentiometer.

6. The solid state illumining system of claim 1, wherein the monitoring module comprises a photo-sensing unit, for detecting the light condition from where the photo-sensing unit is disposed.

7. The solid state illumining system of claim 1, wherein the plurality of the remote illuminating modules are connected with the power supplying module via a power supplying rail.

* * * * *